US006290410B1

(12) United States Patent
Sunada et al.

(10) Patent No.: US 6,290,410 B1
(45) Date of Patent: Sep. 18, 2001

(54) MODULAR AUTODUPLEX MECHANISM WITH SIMPLE LINKAGE

(75) Inventors: Craig D. Sunada; Carl D. Beckett, both of Vancouver; Kevin D. O'Hara, Washougal; Jeffrey R. Blackman, Vancouver, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/607,679

(22) Filed: Jun. 30, 2000

Related U.S. Application Data

(63) Continuation-in-part of application No. 09/283,107, filed on Mar. 31, 1999, now Pat. No. 6,167,231.

(51) Int. Cl.[7] ..... B41J 11/58; G03G 15/00; B65H 5/22

(52) U.S. Cl. ..... 400/624; 400/605; 399/110; 399/393; 399/401; 399/402; 271/3.01; 271/186; 271/258.05; 271/225; 355/24; 347/104

(58) Field of Search ..... 400/605, 625, 400/636, 624, 578; 399/110, 393, 401, 402, 406; 271/3.01, 227, 4.01, 186, 225, 258.05; 101/231, 232, 230; 355/24; 347/104

(56) References Cited

U.S. PATENT DOCUMENTS 4,488,801 * 12/1984 Gibson ..... 399/401
4,788,575 11/1988 Ito et al. .
4,810,120 * 3/1989 Narita et al. ..... 400/624
4,901,117 * 2/1990 Derrick ..... 399/402
4,979,727 * 12/1990 Kolke et al. ..... 271/186
5,042,790 * 8/1991 Miller et al. ..... 271/110
5,146,087 9/1992 VanDusen .
5,153,663 * 10/1992 Bober ..... 399/406
5,384,619 1/1995 Yokomizo et al. .
5,409,203 * 4/1995 Okamoto et al. ..... 271/3.01
5,481,354 1/1996 Nakajima .
5,511,771 * 4/1996 Rubscha ..... 271/4.01
5,540,425 * 7/1996 Graef et al. ..... 271/225
5,600,429 2/1997 Kutsuwada .
5,638,181 6/1997 Kubo et al. .
5,772,343 * 6/1998 Beretta et al. ..... 400/624
5,790,924 8/1998 Creutzmann et al. .
5,800,083 * 9/1998 Gaarder et al. ..... 400/605
5,836,706 11/1998 Ruhe .
5,839,032 11/1998 Yasui et al. .

* cited by examiner

*Primary Examiner*—Eugene Eickholt

(57) ABSTRACT

A modular duplex media handling system used in conjunction with a simplex media handling print recording apparatus, includes a drive roller having a simple gear linkage. The simple gear linkage provides a fixed rotational relationship between the drive roller and a feed roller of the simplex handling apparatus. A media guide pivots about the drive roller's axle between a first position into which it is biased, and a second position into which it is deflected by a media sheet. From the first position, a media sheet retracting from a print zone can enter the duplex media handling system. From the second position, a media sheet can move from the input tray around the feed roller into the print zone, or move out of the duplex media handling system back into the input tray to await refeeding for second side printing.

15 Claims, 5 Drawing Sheets

DRIVE ROLLERS
44
FEED ROLLERS
60
METERING ROLLERS
78
84
92
91
94
48
TO DRIVE MOTOR 16

M
40
68
74
70
52
56
66
76
121
69
80
45
44
121
122
42
121
69
78
71
60
62
112
110

MODULAR AUTODUPLEX MECHANISM WITH SIMPLE LINKAGE

CROSS REFERENCE TO RELATED APPLICATIONS

This is a continuation-in-part of U.S. patent application Ser. No. 09/283,107 filed Mar. 31, 1999 of Jeffrey Blackman et al. for "Print Recording Apparatus Having Modular Autoduplex Mechanism" now U.S. Pat. No. 6,167,231. The content of such application is incorporated herein by reference and made a part hereof.

BACKGROUND OF THE INVENTION

This invention relates generally to methods and apparatus for printing on two side; of a media sheet, and more particularly, to a media handling system which first feeds a media sheet with a first side exposed to a print source, then feeds the media sheet with a second side exposed to the print source.

Printing to two sides of a media sheet, referred to as duplex printing, is a desirable feature in printing systems. The advantages of duplex printing include reducing the amount of paper required compared to one-sided (simplex) printing, and generating print sets with layouts resembling that of professionally printed books. Conventional duplex printing devices employ complex paper handling mechanisms. Typically, an extra tray is used for temporary storage of pages having printing on a first side. In an alternative approach a second paper path is provided to route a first printed page around the existing paper supply.

Similarly, duplex copying typically is accomplished by either one of two methods. In one method, first side copies are stacked in a duplex tray. When a set of first side copies is complete, the copies are fed out of the duplex tray and returned with an odd number of inversions along a duplex path to receive second side imaging. In an alternative method first side copies are returned directly to receive second side imaging without stacking.

Conventional devices tend to have long paper paths and many parts. A substantial challenge with systems having these complex duplex printing paper paths is handling paper jams. Accordingly, there is a need for a simplified method and apparatus for duplex media handling at a desktop print recording device.

SUMMARY OF THE INVENTION

According to the invention, a modular duplex media handling system is used in conjunction with a simplex media handling print recording apparatus. The simplex media handling system includes firmware for operating either in a simplex mode or in a duplex mode, (where the modular duplex media handling system is installed to operate in duplex mode).

According to one aspect of the invention, the modular duplex media handling system includes a drive roller having a fixed gear linkage to the host print recording system's drive motor. There is no transmission or changing of gears along the drive path of the drive roller. Further, the drive motor drives both a feed roller of the simplex media handling system and the drive roller of the duplex media handling system. The simple gear linkage of the duplex media handling system provides a fixed rotational relationship between the drive roller and a feed roller of the simplex handling system. When the feed roller rotates in one direction, the drive roller rotates in a first direction. When the feed roller rotates in another direction, the drive roller rotates in a second direction. In one embodiments the fixed relationship ha the drive roller always rotating in the same direction as the feed roller. In an alternative embodiment, the drive roller always rotates in an opposite direction to the feed roller.

According to another aspect of the invention, the modular duplex media handling system includes a media guide which pivots about the drive roller axle. The media guide has a first position into which it is biased, and a second position into which it is deflected by a media sheet. The media sheet deflects the media guide at either of two portions of the media guide. As the media sheet traverses a first media path for first side printing, the media sheet encounters and deflects the media guide at a first portion into the second position. Once the media sheet passes, the media guide is biased back to the first position. As the media sheet follows a exit path from the duplex media handling system, the media sheet deflects the media guide at a second portion into the second position. Again, once the media sheet passes, the media guide is biased back to the first position. While the media guide is in the first position, the media sheet is able to move into an entry of the duplex media handling system as the media sheet moves back from the print zone. While the media guide is in the second position, the media sheet is able to move from the input tray around the feed roller into the print zone to receive print recording, or move out of the duplex media handling system back into the input tray to await refeeding for second side printing.

According to one advantage of the invention, duplex printing is achieved without user intervention. The user need not manually reorient the media sheet or reinsert the media sheet. According to another advantage the duplex module directly engages the host system print recording mechanism and is directly driven without an intervening transmission. Avoiding a transmission and gear changes results in a faster duplex handling process and thus increased throughput. According to still another advantage, the modularity allows the duplex handling module to be decoupled from the host system. This allows late point differentiation of the print recording system into one of multiple models for delivery into the distribution chain or to an end-user. Further, the module can be swapped with a simplex rear paper guide as desired by an end user. These and other aspects and advantages of the invention will be better understood by reference to the following detailed description taken in conjunction with the accompanying drawings.

DESCRIPTION OF SPECIFIC EMBODIMENTS

Overview

Figure 1:
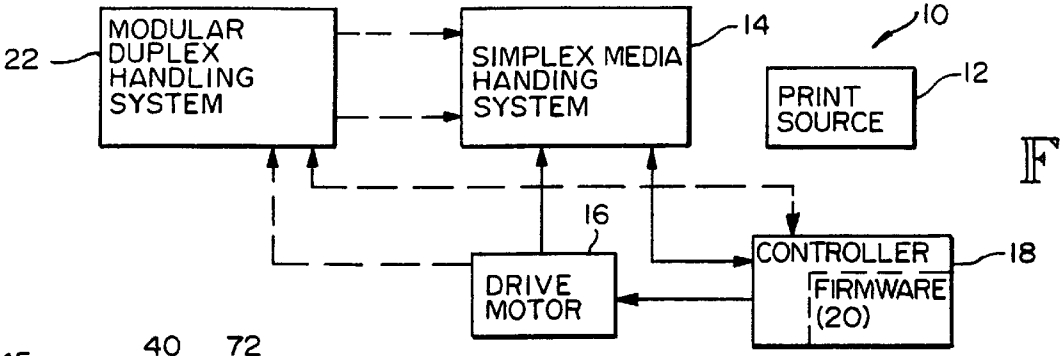
FIG. 1 is a block diagram of a print recording system according to an embodiment of this invention.

Referring to FIG. 1, a print recording system 10 includes a print source 12, a simplex media handling system 14, a drive motor 16 and a controller 18 with firmware 20. Also included in the system 10 is a modular duplex media handling system 22. The duplex media handling system 22 is removable, allowing the system 10 to be customized for simplex printing models and duplex printing models.

Figure 2:
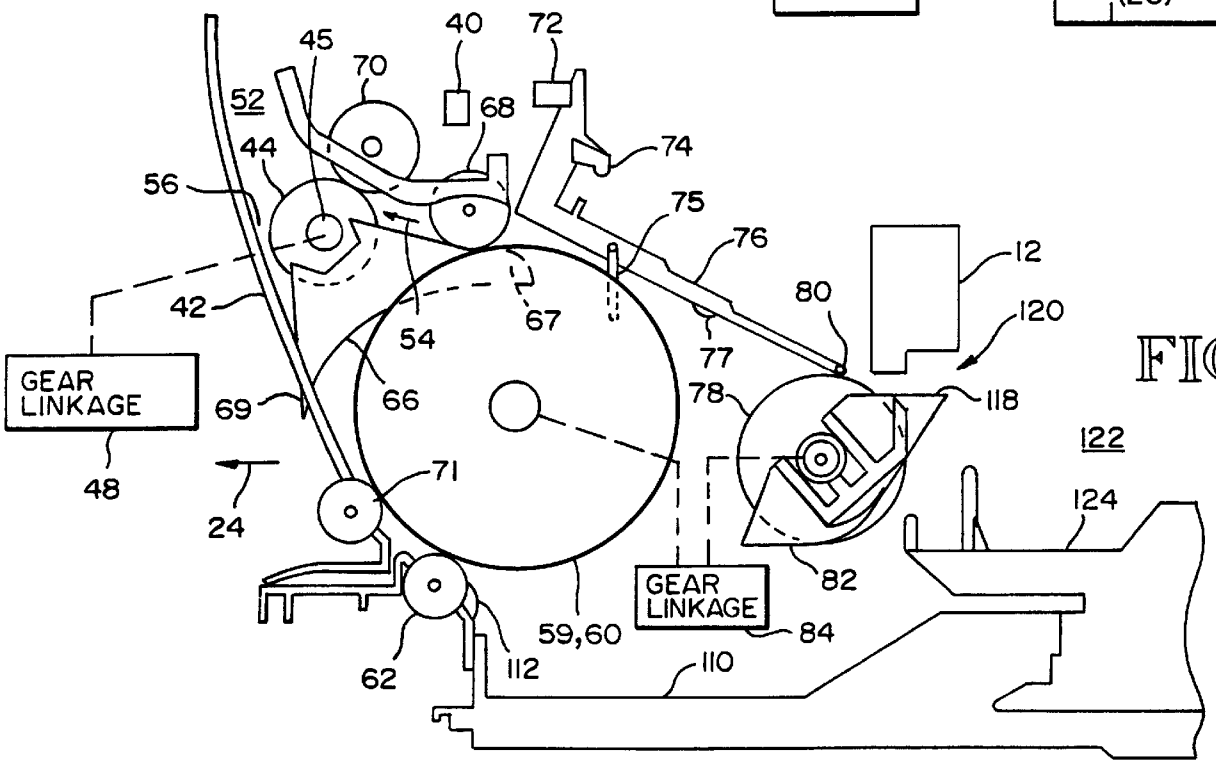
FIG. 2 is a planar view of a portion of the simplex media handling system and modular duplex handling system of FIG. 1 according to an embodiment of this invention.
Figure 3:
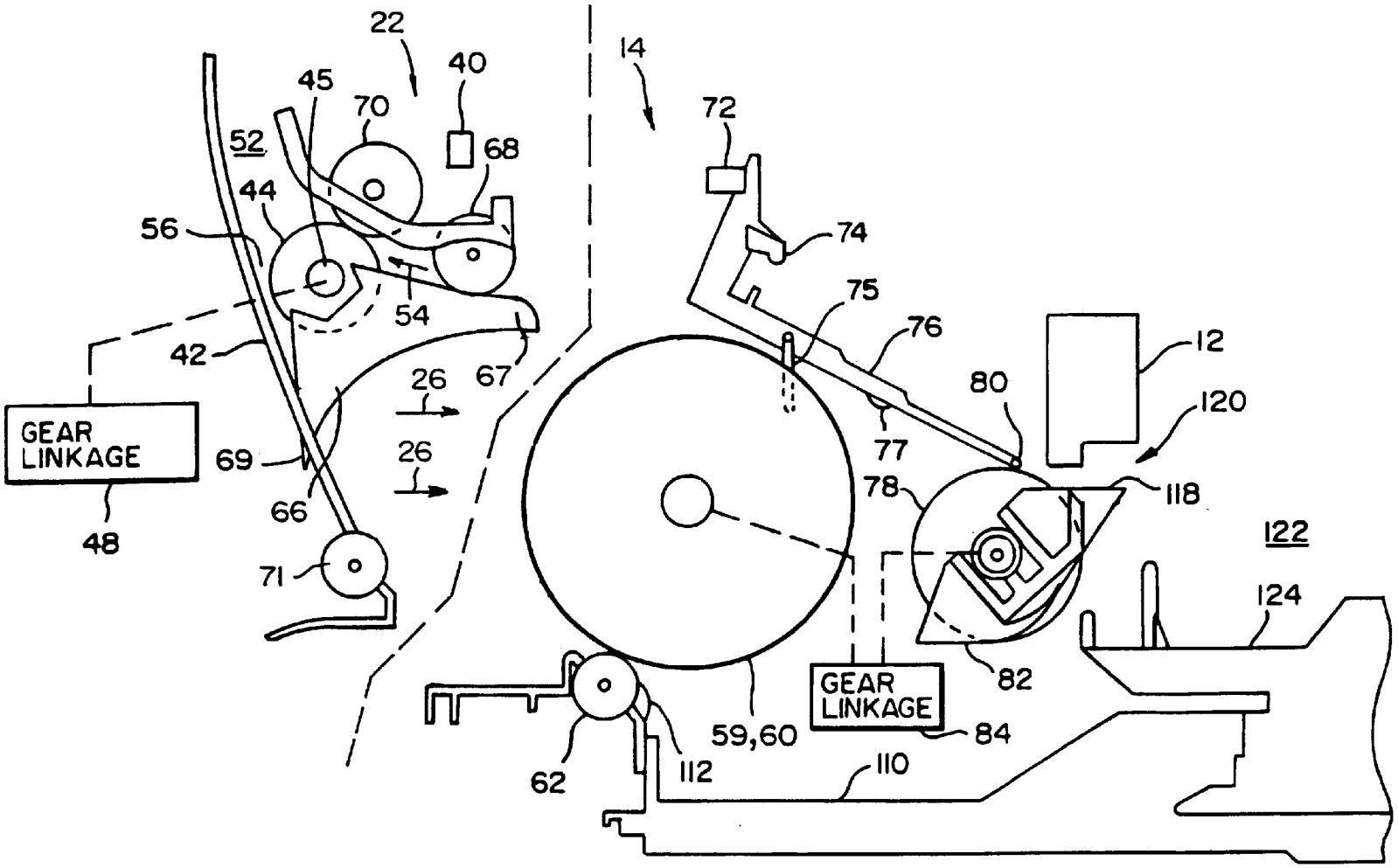
FIG. 3 is an exploded planar view of the duplex handling system separated from the simplex handling system of FIG. 2 according to an embodiment of this invention.

Referring to FIG. 2, the print source 12, simplex media handling system 14 and duplex media handling system 22 are shown for an inkjet printer embodiment. FIG. 3 shows the same structure with the duplex handling system 22 detached. The duplex media handling system 22 is easily removed by sliding the module 22 in direction 24 (see FIG. 2), then lifting the module away from the simplex media handling system 14. The duplex media handling system 22 is installed by removing a rear access door, then lowering the system 22 into a housing for the print recording system 10. The duplex media handling system 22 then is slid in direction 26 (see FIG. 3) toward the simplex media handling system 14. The duplex media handling system 22 engages to the simplex media handling system 14 using the same mechanical interface as was used for the removed rear access door.

The duplex media handling system 22 includes a sensor 40 which interfaces with the controller 18, allowing the controller 18 to detect whether the duplex media handling system 22 is present in the print recording system 10. An electrical, electromechanical and/or electro-optical connection is included to interface the sensor 40 output with the controller 18. The controller 18 tests to determine whether the duplex media handling system 22 is installed. Specifically, if a sensor 40 signal is present, then the system 22 is installed (since the sensor is part of the system 22). In response, the controller 1I firmware 20 enables both simplex printing and duplex printing operations. If a sensor 40 signal is not present, then the controller 18 firmware 20 disables duplex printing operations and allows simplex printing operations.

In operation the print recording system 10 receives a media sheet upon which text, graphics or other symbols are to be recorded. For example, in an inkjet printer embodiment the printer receives a print job from a host computer (not shown). The controller 18 controls the drive motor 16 and print source 12 coordinating the movement of the media sheet relative to the print source 12. For single-sided (i.e., simplex) printing, the media sheet is fed through the simplex media handling system 14 adjacent to the print source 12 where the text, graphics or other symbols are recorded on the media sheet. For duplex printing, the media sheet is fed through the simplex media handling system 14 along a media path to perform first-side printing. The media sheet then is fed back along a portion of the media path into a shute within the duplex handling system 22. The duplex handling system then reverses motion of the media sheet and feeds the media sheet back into the input tray 110. In effect the media sheet M has been flipped and is ready to be picked for second side printing. The media subsequently is picked then fed through the simplex media handling system 14 along the original media path to achieve second side printing.

Referring to FIG. 3, the duplex media handling system 22 includes the sensor 40, a frame 42, a drive roller 44, a gear linkage 48, a media guide 66, pinch rollers 68, 70, 71. The gear linkage 48 couples the drive roller 44 to the print recording system's drive motor 16. During duplex printing, a media sheet is fed within the duplex media handling system 22 into a shute 52. The media sheet is received at media guide 66 and fed by the simplex media handling system 14 feed roller 60 toward the drive roller 44. At drive roller 44, the media sheet is held by pinch roller 70 allowing the drive roller to advance the media sheet into the shute 52. The drive roller 44 advances the media sheet from an entry point 54 into the shute, then out of the shute to an exit point 56. The detailed operation for controlling the movement of the media sheet is described below in the operation section.

Referring to FIGS. 2 and 3, the simplex media handling system 14 includes pick roller 59, feed rollers 60, feed idlers 62, a media sensor 72, flag 74, secondary flag 75, an upper guide 76, and metering rollers 78 with another set of pinch rollers 80, a pivot mechanism 82 and gear linkage 84. The drive motor 16 (see FIG. 1) is coupled to the feed rollers 60 and metering rollers 78 through the gear linkage 84. An opening is included for receiving the duplex media handling system 22.

Figure 4:
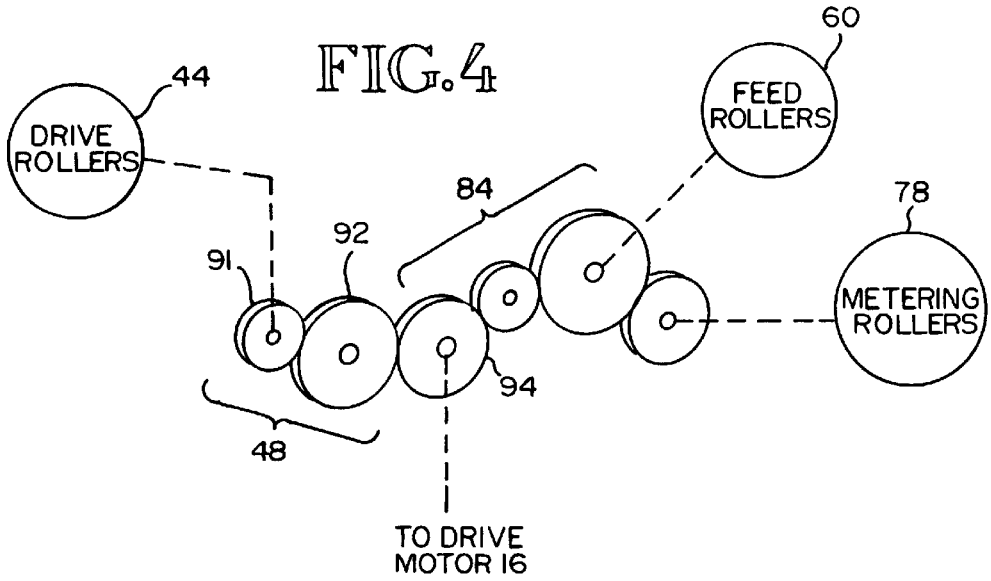
FIG. 4 is a diagram of the gear linkages for the simplex media handling system and the duplex media handling system according to one embodiment.
Figure 7:
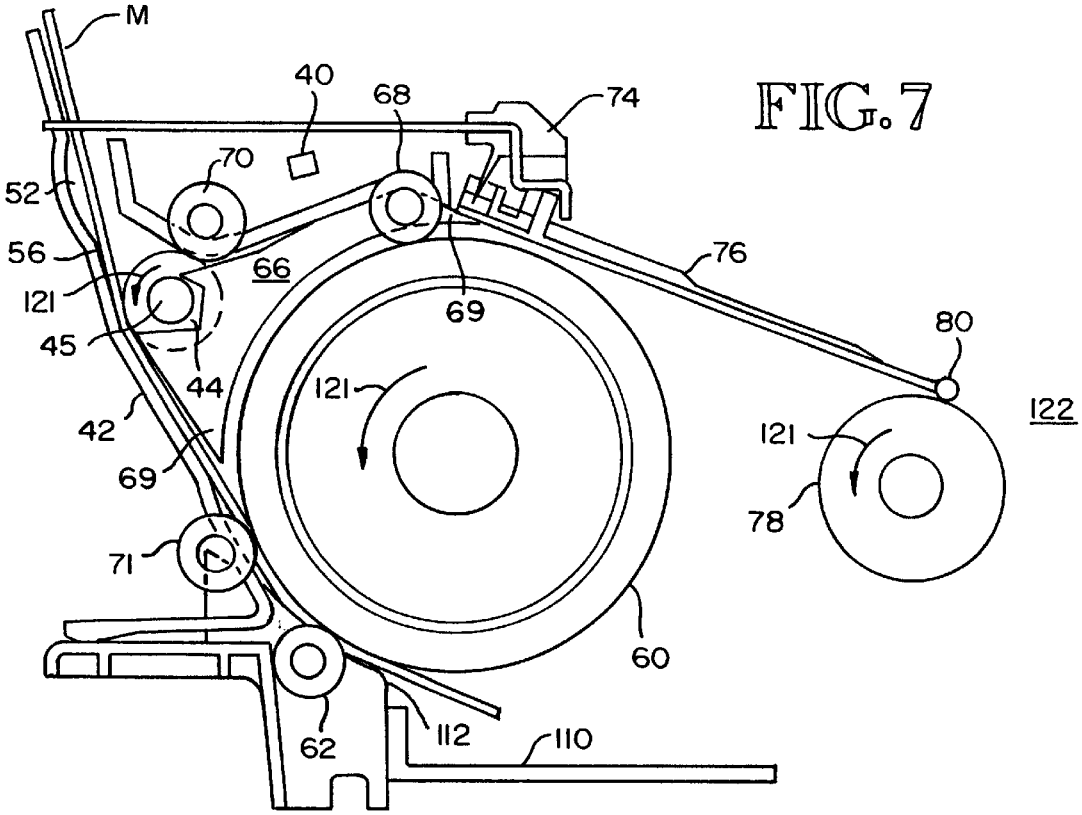
FIG. 7 is a diagram of the duplex media handling system and simplex media handing system showing a media sheet exiting the duplex media handling system for movement into the input tray.

Referring to FIG. 4, the gear linkage 48 of the duplex media handling system 22 includes one or more gears 91, 92, including a gear 92 which directly engages a gear 94 of the simplex media handling system 14 gear linkage 84. The gear linkage 48 is a simple gear linkage without a transmission. The drive motor 16 drives both the feed roller 60 of the simplex media handling system 14 and the drive roller 44 of the duplex media handling system 22. The simple gear linkage 48 provides a fixed rotational relationship between the drive roller 44 and the feed roller 60. When the feed roller 60 rotates in one direction, the drive roller 44 rotates in the same direction. When the feed roller rotates in another direction, the drive roller rotates in such other direction. In an alternative embodiment, rather than rotate in the same direction as the feed roller 60, the gear linkage 44 is configured to rotate the drive roller 44 in the opposite direction of feed roller 60.

In a preferred embodiment the feed rollers 60 and metering rollers 78 are driven in a common direction during simplex or duplex media handling. That common direction changes during duplex printing, but is the same for the feed rollers 60 and metering rollers 78. Accordingly, the drive roller 44 rotates in the same direction as the feed rollers 60 and metering rollers 78.

The action of the duplex media handling system's media guide 66 is summarized below. The media guide 66 pivots about an axle 45 of the drive roller 44 between a first position and a second position. The media guide 66 is shown in the first position in FIGS. 2 and 6, and is shown in the second position in FIGS. 5. and 7. Normally, the media guide 66 remains in the first position based on a gravitational force, a spring-biasing force or another biasing force. The media guide 66 is deflected into the second position by the media sheet M as the media sheet is being driven. The driving of the media sheet M presents a force upon the media guide 66 which overcomes the gravitational force or other biasing force.

The media sheet M impinges upon the media guide 66 at either of two portions 67, is 69 of the media guide 66. As the media sheet M moves from the input tray 110 around the feed roller 60 toward the media path 114, the media sheet M encounters and deflects the media guide 66 at the first portion 67. As the media sheet M exits the duplex media handling system 22, the media sheet M deflects the media guide 66 at the second portion 69.

While the media guide 66 is in the first position, the media sheet M is able to move back from the print zone 120 into the duplex media handling system 22. While the media guide 66 is in the second position, the media sheet M is able to move from the input tray 110 around the feed roller 60 into the print zone 120 to receive print recording, or move out of the duplex media handling system 22 back into the input tray 110 to await refeeding for second side printing.

Operation

Figure 5:
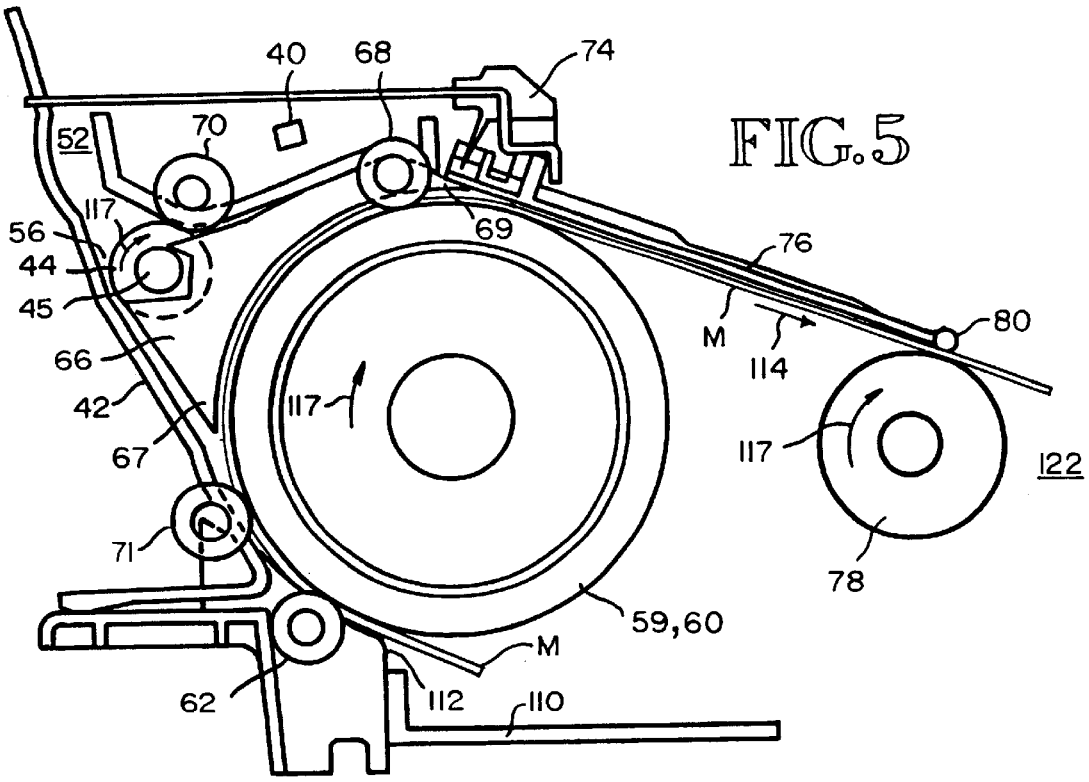
FIG. 5 is a diagram of the duplex media handling system and simplex media handing system during the pick and feed of a media sheet for either one of first side printing or second side printing.

The media handling operations for simplex and duplex media recording are described with regard to FIGS. 2–7. For either simplex or duplex print recording, a media sheet M is lifted into contact with a pick roller 59. The top sheet M is picked from a stack of media sheets in an input tray 110. Excess sheets are retarded by a restraint pad system 112 (see FIGS. 2, 3). Referring to FIGS. 2 and 5, the picked media sheet M is fed around feed rollers 60. The feed idlers 62 and pinch rollers 71 press the media sheet to the feed and pick rollers 59, 60. As the media sheet moves along the feed rollers 60, the media sheet M acts upon a first portion 67 of the media guide, deflecting the media guide 66 from a first position into a second position out of the media path. Once the trailing edge passes beyond the media guide 66, the media guide 66 returns to the first position based upon either one of a gravitational force or another biasing force.

Beyond the media guide 66, the media sheet moves along a first media path 114. The media path 114 spans a path from pinch rollers 68 to the metering rollers 78 and into a print zone 120 (print zone shown in FIG. 2 and 3. The media sheet M is moved between the feed rollers 60 and the pinch rollers 68, under the upper guide 76 and onto the metering rollers 78. Pinch rollers 80 press the media sheet to the metering rollers 78. Both the metering rollers 78 and the feed rollers 60 are moving in a forward direction 117 during the first side printing operation. The duplex media handling system drive roller 44 also rotates in direction 117 during this time period, Eventually a trailing edge of the media sheet M passes beyond the feed rollers 60 so that the metering rollers 78 move the media sheet.

Beyond the pinch rollers 80, the media sheet moves along a platform 118 of the pivot mechanism 82 (see FIGS. 2 and 3). The print source 12 is located adjacent to the platform 118. The area between the platform 118 and the print source 12 is referred to herein as the print zone 120. The media sheet M is fed through the print zone 120 into an output region 122, which in some embodiments includes an output tray 124 (see FIGS. 2 and 3). For simplex printing, the media sheet is released into the output region 122. Immediately or after a suitable drying time (depending on the type of print source), another media sheet may be picked and fed along the media path 114 through the print zone 120 for print recording.

For duplex printing, the above operations occur for first side printing. However, the trailing edge of the media sheet M is not released from the pinch rollers 80 during the first-side printing. While the pinch roller 80 presses the trailing edge of the media sheet M to the metering roller 78, the motion of the feed rollers 60 and metering rollers 78 ceases. A suitable drying time is allowed, then the drive motor 16 reverses the rotational direction of the feed rollers 60, metering rollers 78 and drive roller 44 to a direction 121 (gee FIG. 6). In one embodiment for a wet ink print recording system (e.g., inkjet print recording) the sensor 40, which indicates whether the duplex media handling system is installed, is a humidity sensor. The sensor 40 detects the ambient humidity. Controller 18 in response to the detected humidity determines a sufficient drying time before allowing the media sheet to be moved for second side printing. In alternative embodiments separate sensors are used to determine humidity and whether the duplex media handling system is installed. In other embodiments, a sensor is not included for detecting drying time (e.g., non-wet ink printing; a worst case, or even a typical case, drying time is programmed in without sensory indication). Regardless of the sensor 40 embodiment, the controller 18 includes firmware programmed to handle simplex printing or duplex printing. The sensor 40 indication of whether the duplex media handling system is installed or not installed is used by the firmware to determine whether the duplex mode is available.

The determination of when to stop the metering rollers 78 with the media sheet trailing edge grasped is now described. The simplex media handling system 14 includes a media sensor 72 and flag 74 (see FIGS. 2 and 3). When the media sheet M is moved along the first media path 114 from the feed rollers 60 toward the metering rollers 78, the lead edge of the media sheet trips the flag 74. Once the trailing edge 123 passes beyond the flag, the flag 74 returns to its unbiased position. The sensor 72 indicates when the leading edge and trailing edge of the media sheet M have passed the flag 74. These indications are detected by the controller 18 which then determines when the trailing edge 123 of the media sheet M is at the pinch roller 80. At such time the controller 18 has the drive motor 16 discontinue rotation of the feed rollers 60 and metering rollers 78. After a programmed pause (e.g., to allow for first side drying), the controller 18, then signals to the drive motor 16 to reverse the rotational directions of the feed rollers 60 and metering rollers 78 to the reverse direction 121. The duplex media handling system drive roller 44 being coupled to the drive motor also is reversed to rotate in direction 121.

Figure 6:
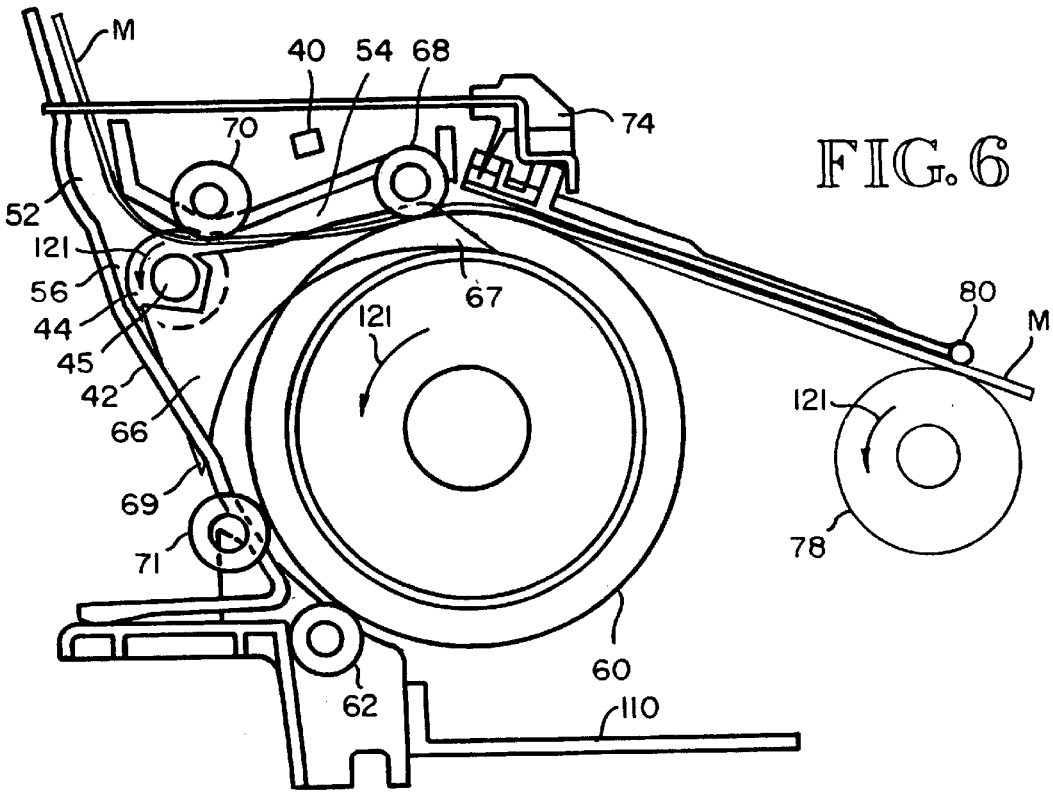
FIG. 6 is a diagram of the duplex media handling system and simplex media handing system after first side printing, showing retraction of the media sheet and movement of the media sheet into the duplex media handling system according to an embodiment of this invention.

Referring to FIG. 6, the metering rollers 78 feed the media sheet M back along the first media path 114 into contact with the feed rollers 60. The feed rollers 60 then continue feeding the media sheet back. As the media sheet advances along the feed roller, the media sheet M encounters the media guide 66 positioned in its first position blocking further movement around the feed roller 60 (e.g., toward the input tray 110). Instead the media guide 66 redirects the media sheet M over the media guide 66 to the entry point 54 of the duplex media handling system 22.

As the feed roller 60 moves the media sheet M into the duplex media handling system 22, the media sheet is received by the pinch roller 70 which presses the media sheet M against the drive roller 44. The feed roller 60 and drive roller 40 continue to move the media sheet M into the duplex media handling system 22. Specifically, the media sheet is fed into a shute 52. Eventually the media sheet moves beyond the grip of the feed roller to be driven by the drive roller 44. As the drive roller continues to rotate in the direction 121 the trailing edge of the media sheet passes beyond the pinch roller 70. At such time the media sheet is substantially free of the driving force. However, the shute 52 is oriented vertically relative to the drive roller 44. Thus, the media sheet does not advance further into the shute. Instead the trailing edge of the media sheet is biased by gravity to the drive roller 44.

As the drive roller 44 rotates in direction 121, the trailing edge of the media sheet moves around a portion of the drive roller 44 toward the exit 56 of the duplex media handling system 22. In doing so, the trailing edge becomes a leading edge and. re-enters the grip of the drive roller 44.

Figure 8:
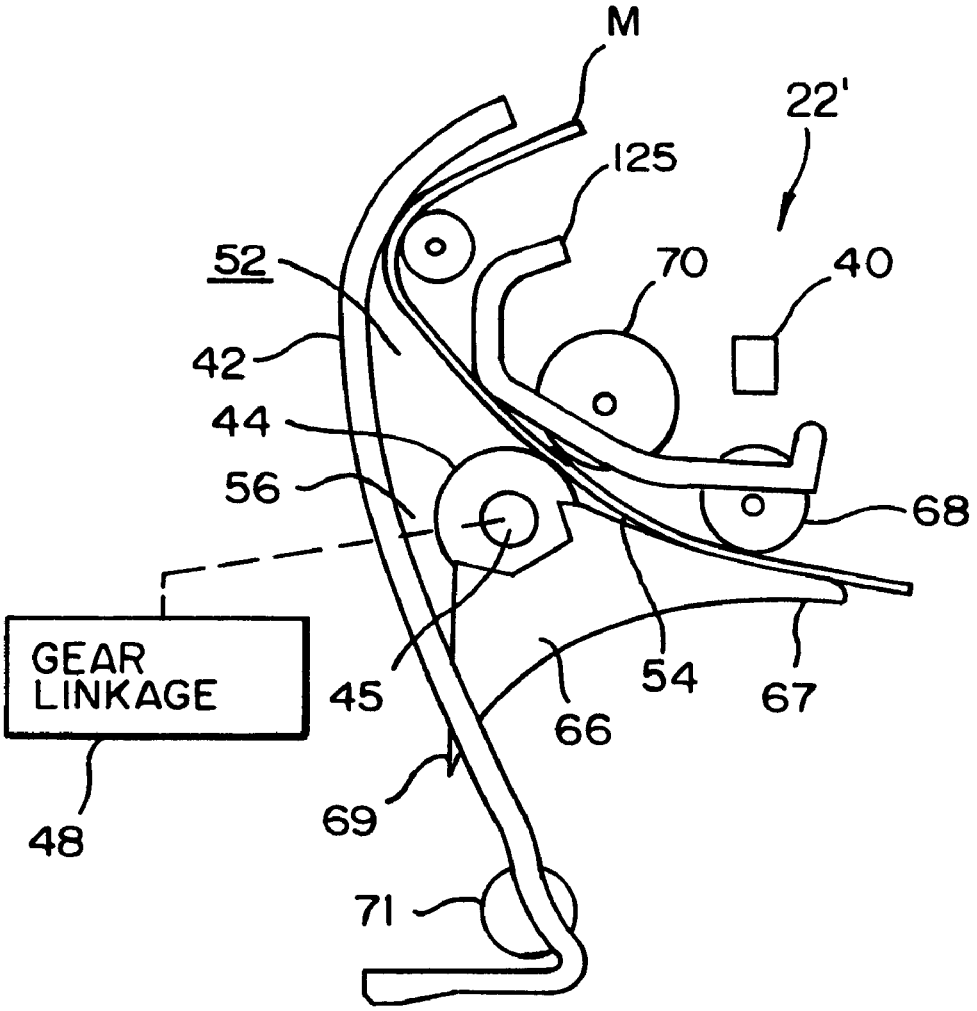
FIG. 8 is a diagram of a duplex media handling system according to an alternative embodiment of this invention.

In an alternative embodiment (see FIG. 8), rather than rely on gravity to bias the media sheet back toward the drive roller 44, a pinch roller 125 is located within the shute 52 along the path of the media sheet M. The media sheet M is fed into the shute 52 and into engagement with the pinch roller 125 by the drive roller 44. In one embodiment the pinch roller 125 biases the media sheet back toward the drive roller 44 without preventing advancement of the media sheet into the shute. For example, the pinch roller 125 is spring biased to apply a force onto the media sheet which has one force component biasing the media sheet back toward the drive roller 44 and another force component pressing the media sheet to one wall of the shute 52. In varying embodiments the system is designed to bias the media sheet to any of different walls of the shute with a force component biasing the media sheet back toward the drive roller 44. As the media sheet enters the shute the drive roller 44 applies a force overcoming the bias force applied by the pinch roller 125 allowing the media sheet to advance in the shute. Once the media sheet trailing edge reaches the drive roller 44, the trailing edge moves with the drive roller 44 as the pinch roller 125 force keeps the media sheet adjacent to the drive roller 44. Specifically, the pinch roller 125 keeps the media sheet M from being moved out of contact with the drive roller 44. The trailing edge then becomes a leading edge which is fed out the shute 52 by the drive roller 44. The drive roller 44 remains rotating in the same direction 121 during the loading and unloading of the media sheet into the shute 52.

For either duplex media handling system 22, 22' embodiment, the drive roller now pulls the media sheet from the shute 52 and out the exit 56 back toward a second portion 69 of the media guide 66. The moving media sheet deflects the media guide 66 into the second position allowing the media sheet to progress out the duplex media handling system.

The duplex media handling system exit is located adjacent another portion of the feed roller 60. The exiting media sheet M encounters the feed roller 60 and is fed by the feed roller 60 and drive roller 44 into the input tray 110 (see FIG. 7). Note that the media sheet M has been flipped. The side of the media sheet M that was face-up within the input tray 110 prior to being picked and fed for first side printing is now face down in the same input tray 110. Such flipping effect is achieved as the trailing edge of the media sheet moves around the drive roller 44 after leaving the grip of pinch roller 70. Such flipping action is achieved while rotating the feed rollers 60 and drive rollers 44 in a constant direction 121. Specifically, the rotational direction of the drive roller 44 and feed roller 60 is not changed during the retraction of the media sheet M from the print zone 120, and the continued movement of the media sheet M into the shute 52, out of the shute 52 and into the input tray 110.

With the media sheet M back in the input ray 110, the drive motor reverses the drive action to rotate the feed rollers 60, metering rollers 78 and drive roller 44 in the original direction 117. The media sheet M is lifted into contact with the pick roller 59, separated from the stack by separator surface 112 (see FIG. 2) and picked to be fed along the feed rollers 60. The media sheet M is fed around feed roller 60. In doing so, the media guide 66 second portion 69 blocks the pathway at the exit of the duplex media handling system 22. The media sheet is fed around the feed roller 60. As the media sheet M progresses further, the media sheet encounters the first portion 67 of the media guide 66. The media sheet M deflects the media guide 66 to allow progress onto the first media path 114. The media sheet progresses along the media path 114, under the guide 76 to the metering rollers 78 and pinch roller 80, then into the print zone 120 for second side printing.

The action of the media guide 66 is summarized below. The media guide 66 pivots about the drive roller 44 axle 45 between a first position and a second position. The media guide is shown in the first position in FIGS. 2 and 6, and is shown in the second position in FIGS. 5 and 7. Normally, the media guide 66 remains in the first position based on a gravitational force, a spring-biasing force or another biasing force. The media guide is deflected into the second position by the media sheet as the media sheet is being driven. The driving of the media sheet presents a force upon the media guide 66 which overcomes the gravitational force or other biasing force.

The media sheet impinges upon the media guide 66 at either of the two portions 67, 69 of the media guide 66. As the media sheet M traverses moves from the input tray around the feed roller 60 toward the media path 114, the media sheet deflects the media guide 66 at the first portion 67. As the media sheet exits the duplex media handling system 22, the media sheet M deflects the media guide 66 at the second portion 69.

While the media guide 66 is in the first position, the media sheet is able to move back from the print zone into the duplex media handling system 22. While the media guide is in the second position, the media sheet is able to move from the input tray around the feed roller into the print zone to receive print recording, or move out of the duplex media handling system back into the input tray to await refeeding for second side printing.

Meritorious and Advantageous Effects

One advantage of the invention is that media flipping is provided without user intervention or reinsertion. Another advantage is that additional motors are not needed for the duplex module. The duplex module is powered by the simplex media handling system. Another advantage is that the transmission switches gears in response to a lever, activated by the media sheet motion, rather than in response to a drive motor jogging action, As a result the time to shift gears reduces. Correspondingly, the time perform a duplex handling print cycle is reduced and the printer throughput is increased.

Another advantage is that by avoiding activation by the drive motor a larger design margin is tolerated by the gear trains in the transmission. Another advantage is that a lighter friction load is placed on the drive motor by the interference member. In the embodiment where the clutch is activated by the drive motor a higher, undesirable friction load is placed on the drive motor. Such load is not constant over the live of the printer. The interference member places a much lower, less critical friction load on the drive motor. According to another advantage of the invention, by activating the transmission drive modes directly in response to the media sheet position, media length need not be sensed for the purpose of controlling the drive motor to alter the transmission drive modes. The direct actuation of the transmission drive mode frees up bandwidth for the print controller.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A method for duplex handling, comprising:

feeding a media sheet with a feed roller for print recording onto a first side;

after first side print recording, reversing motion of the media sheet and redirecting the media sheet with a first media guide into engagement with a drive roller of a duplex handling module;

driving entry of the media sheet with the drive roller into a shute;

after a trailing edge of the media sheet is released from a first pinch point, engaging a second pinch point to drive the media sheet to exit the shute, wherein the media sheet encounters a second media guide;

receiving the media sheet onto the feed roller;

feeding the media sheet into an input tray;

picking the media sheet from the input tray; and feeding the media sheet for print recording onto a second side, wherein the second media guide blocks re-entry of the media sheet back into the shute.

2. The method of claim 1, wherein the drive roller rotates in a common direction during media sheet entry and exit.

3. The method of claim 2, wherein exiting of the shute is achieved as a trailing edge of the media sheet enters the duplex media handling module and follows along the drive roller from the first drive roller pinch point to the second drive roller pinch point, the trailing edge during entry of the media sheet becoming a lead edge during exit of the media sheet.

4. The method of claim 1, further comprising biasing the media sheet to remain in contact with the drive roller as the trailing edge moves from the first pinch point to the second pinch point.

5. The method of claim 4, in which the step of biasing comprises pressing the media sheet into engagement with the shute with a pinch roller.

6. The method of claim 1, wherein the first media guide and the second media guide form a rigid member which is deflected by the media sheet during the steps of feeding the media sheet for first side printing, feeding the media sheet for second side printing, and reversing motion of the media sheet to exit the shute.

7. The method of claim 1, wherein during each step the drive roller rotates in a fixed rotational relationship to rotation of the feed roller.

8. A print recording apparatus for recording print onto a media sheet, comprising;

a print recording source;

an input tray for holding a stack of media sheets;

a simplex media handling assembly for moving a media sheet along a first media path to receive print recording, the simplex media handling assembly comprising a feed roller;

a duplex media handling module interfacing with the simplex media handling assembly to provide a portion of a second media path for flipping the media sheet for second side printing, the duplex media handling module comprising a duplex handling drive roller, a media guide and a shute; and a drive motor for driving rotation of the feed roller and the drive roller, wherein the drive roller rotates in a fixed rotational relationship to rotation of the feed roller, the drive roller having a fixed unchanging gear linkage to the drive motor;

wherein the media sheet is fed around the feed roller along the first media path into a print zone for print recording onto a first side of the media sheet;

wherein after first side print recording is complete, motion of the media sheet is reversed and redirected with the media guide into the duplex handling module where the drive roller drives the media sheet into the shute;

wherein after a trailing edge of the media sheet is released from a first pinch point, a second pinch point is engaged to drive be media sheet to exit the shute, the media sheet encountering and deflecting a second media guide while exiting and being fed onto the feed roller which in turn feeds the media sheet into the input tray;

wherein the media sheet having completed first side print recording is picked from the input tray and fed around the feed roller along the first media path into the print zone for print recording onto a second side, the media guide blocking re-entry of the media sheet back into the shute.

9. The apparatus of claim 8, wherein the drive roller drives movement of the media sheet into the shute and reverses motion of the media sheet to drive movement of the media sheet out the chute while rotating in a common unchanged direction.

10. The apparatus of claim 8, wherein exiting of the shute is achieved as a trailing edge of the media sheet enters the duplex media handling module and follows along the drive roller from the drive roller pinch point to an exit point, the trailing edge during entry of the media sheet becoming a lead edge during exit of the media sheet.

11. The apparatus of claim 10, wherein the media sheet follows along the drive roller from the drive roller pinch point to an exit point based on a gravitational force.

12. The apparatus of claim 8, wherein the media guide pivots about an axle of the drive roller and comprises:

a first portion which blocks entry of the media sheet into the duplex handling system when the media sheet is fed from the input tray; and a second portion which directs the media sheet into the duplex media handling module when the media sheet is reversed from the print zone back along first the media path, said second portion blocking the media sheet from moving around the feed roller as the media sheet motion is reversed from the print zone.

13. The apparatus of claim 8, wherein the media guide has a first position into which it is biased, and a second position into which it is deflected by a media sheet, the media guide comprising a first portion and a second portion, wherein as the media sheet traverses a first media path for first side printing, the media sheet encounters and deflects the media guide into the second position;

wherein as the media sheet exits from the duplex media handling system, the media sheet deflects the media guide into the second position;

wherein while the media guide is in the first position, the media sheet is able to move into the entry of the duplex media handling system as the media sheet moves back from the print zone;

wherein while the media guide is in the second position, the media sheet is able to move out of the duplex media handling system back into the input tray to await refeeding for second side printing, and move from the input tray around the feed roller into the print zone to receive print recording.

14. The apparatus of claim 8, further comprising a pinch roller within the shute which biases the media sheet to remain in contact with the drive roller as the trailing edge moves from the first pinch point to the second pinch point.

15. The apparatus of claim 14, in which the pinch roller presses the media sheet into engagement with the shute at a point away from the drive roller.

* * * * *